United States Patent [19]

Woodfill et al.

[11] 4,051,801

[45] Oct. 4, 1977

[54] DRIVE POSITION SIGNALLING APPARATUS

[75] Inventors: William L. Woodfill, Fond du Lac; Edward F. Ginnow, Omro, both of Wis.

[73] Assignee: Brunswick Corporation, Skokie, Ill.

[21] Appl. No.: 699,081

[22] Filed: June 23, 1976

[51] Int. Cl.[2] ..... B63M 11/00

[52] U.S. Cl. ..... 115/12 R; 114/144 R

[58] Field of Search ..... 115/41 R, 41 HT, 35, 115/50, 32, 18 R, 18 E; 114/162, 144 R, 151; 73/431, 432 A; 116/124 C, 124 D, 126, 120 R, DIG. 43; 338/135, 161, 162, 166, 169, 334; 340/177 R; 74/206; 64/30 R, 30 E

[56] References Cited

U.S. PATENT DOCUMENTS

| | | | |
|---|---|---|---|
| 2,024,459 | 12/1935 | Lee | 74/206 |
| 2,069,440 | 2/1937 | Hathorn | 64/30 R |
| 2,586,103 | 2/1952 | Smith | 74/206 |
| 3,605,678 | 9/1971 | Shimanckas | 115/41 R |
| 3,756,185 | 9/1973 | Breslin | 115/12 R |
| 3,844,247 | 10/1974 | Collis | 115/41 HT |

*Primary Examiner*—Trygve M. Blix
*Assistant Examiner*—D. W. Keen
*Attorney, Agent, or Firm*—Andrus, Sceales, Starke & Sawall

[57] ABSTRACT

A marine jet drive unit includes a nozzle which is mounted in a gimbal ring for pivoting about a horizontal axis for trimming of the drive jet. An electric motor drives a gear train including a rotating actuator shaft having an Acme nut actuator connected by a rigid linkage to the gimbal ring for trim positioning of the nozzle. A potentiometer is mounted within the gear housing with an input shaft parallel to the actuator shaft. The outer ends of both shafts are exposed in laterally spaced, aligned relation. A large driven disc element is secured to the potentiometer shaft and has a radium slightly less than the spacing between the two shafts. A pair of small, disc elements are mounted on the actuator shaft with a small flat spring establishing a spring force urging the small, disc elements into clamping engagement with the periphery of the large disc. The gear and actuator shaft are driven through less than one complete revolution by the motor for the complete angular trim orientation of the nozzle. During the initial installation, automatic alignment of the shafts is produced by moving the nozzle to its limit positions. The potentiometer moves to an appropriate limit position during at least one of the trim positions, with slippage between the large and small clamping disc elements permitting the nozzle to move to its limit position and thereby produce proper alignment at the maximum trim position.

17 Claims, 7 Drawing Figures

DRIVE POSITION SIGNALLING APPARATUS

BACKGROUND OF THE INVENTION

This invention relates to a drive position signal apparatus for marine propulsion devices such as outboard motors, inboard/outboard drive units including marine jet propulsion drives.

Marine propulsion devices particularly for small recreational craft generally include outboard motors, stern drive units and the like, and more recently marine jet drive units. The propulsion efficiency in such drive is optimized by tilting of the propulsion unit relative to the boat hull in order to change the relative angle of the thrust forces. In conventional outboard motors and stern drive units, a hydraulic powdered trim system is provided for angular remote setting of the lower propellor unit. Similarly, in marine jet propulsion systems, the thrust forces are trimmed by the proper angular orienting of the drive jet. A steering nozzle is conveniently provided for directing of the jet laterally for steering purposes. By trimming of the position of the steering nozzle, trimming of the drive jet is obtained and once again optimize propulsion forces created for moving of the boat.

The steering and trim control are often located in a forward portion of the boat and connected by mechanical or electrical coupling means to powered means on the propulsion unit. The positioning of the aft-mounted power unit and particularly the trim positioning system desirably incorporates an indicating means at the control station to provide the operator with a continuous trim position reading. Various remote indicating devices have been suggested in which a position transducer is secured to and positioned with the propulsion unit to generate a related electrical signal connected to a remote gauge or other control at the control station.

A simple resistive sensing unit for a trim angle indicating system is disclosed in U.S. Pat. No. 3,641,965. As more fully disclosed therein, a variable resistor is secured to the horizontal trim or tilt axis of a stern drive unit. A movable tap is attached to the trim pivot shaft and positioned on the resistor to produce a signal proportional to the trim angle of the stern drive unit. U.S. Pat. No. 3,834,345 discloses a servo system for powered trim positioning of an outboard motor or similar marine drive device. Various rotary remote sensors are disclosed to generate an electrical signal compared with a preset angle-related signal established at the control station to provide a predetermined powered positioning of the drive unit. Although various systems have been provided for generating a signal in relation to the angular orientation of an outboard unit, they have been primarily developed in connection with the conventional propeller systems. They generally are mechanically coupled and must be accurately aligned at the time of installation to provide proper calibrated outputs. Further, the special construction of the various components and incorporation into the outboard unit produce additional limitations in construction of the indicating and/or control system for connection to marine jet propulsion units. U.S. Pat. No. 3,844,247 discloses a slipping clutch unit having a pair of in-line plates on the shaft unit of a signalling device which requires the provision of the additional coupling shaft and the like. Although such systems provide proper phasing, they do not provide a highly simple and low cost type of coupling which is particularly adapted to commercial implementation. There is a need for a simple and reliable position transducer for indicating the angular orientation such as the trim positioning for marine jet propulsion devices.

SUMMARY OF THE PRESENT INVENTION

The present invention relates to a simple reliable and inexpensive position transducer having a rotating input coupled to a laterally spaced rotating drive positioning element by a simple friction drive including members which are generally plate-like members and which span the spacing therebetween and are resiliently engaged to define a friction connection permitting slippage to automatically properly position the transducer in response to the positioning of the drive unit. Generally, in accordance with the present invention, the drive positioning unit includes a power driven rotating shaft which is reversibly driven to directly correspondingly position the drive unit. An electric signal source includes a rotating input mounted in laterally spaced, parallel alignment to the positioning shaft. the two shafts are coupled to each other by rotating members secured to the shafts and resiliently urged into engagement. The members in a preferred embodiment include a large disc member secured to one of the shafts and frictionally gripped on the periphery by a pair of small disc members secured to the opposite shaft and spring-loaded. The signal source is driven through less than one complete revolution for the complete angular trim orientation of the drive unit. During the initial installation, alignment is produced by moving the power unit to its extreme positions and thereby positioning the signal source to its extreme, with a slippage between the large and small clamping disc members permitting the power unit to move with the source at its limit position and thereby produce proper alignment at the maximum trim position.

In a particularly unique and practical embodiment of the invention as applied to the jet drive unit, a trim nozzle of the jet drive unit is angularly oriented by an electric motor driven mechanism including a rotating actuator shaft and an Acme nut actuator thereon. Linear motion of the actuator is transmitted to the gimbal ring for time positioning of the nozzle. A potentiometer is mounted with a shaft parallel to the actuator shaft and with the outer ends thereof in laterally spaced, aligned relation. A large driven disc is secured to the potentiometer shaft. A pair of small, disc washers are secured to the actuator shaft and include a small disc spring establishing a spring force urging the washers into clamping engagement with the periphery of the large disc.

The present invention provides a simple, reliable and inexpensive position transducer particularly adapted for marine jet drive units and the like for producing accurate signalling of the trim positioning of the jet control means.

BRIEF DESCRIPTION OF THE DRAWINGS

The drawings furnished herewith illustrate the best mode presently contemplated by the inventors for carrying out the present invention, and clearly discloses the above advantages and features as well as others which will be readily understood from the subsequent description of the illustrated embodiments.

In the drawings.

DESCRIPTION OF THE ILLUSTRATED EMBODIMENT

Figure 1:
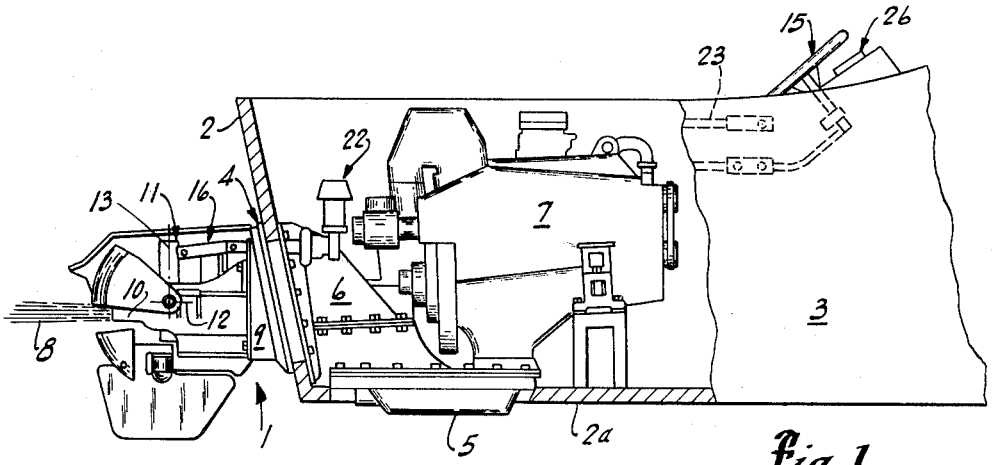
FIG. 1 is a fragmentary side elevational view of a marine jet drive apparatus and transom of a water craft.
Figure 2:
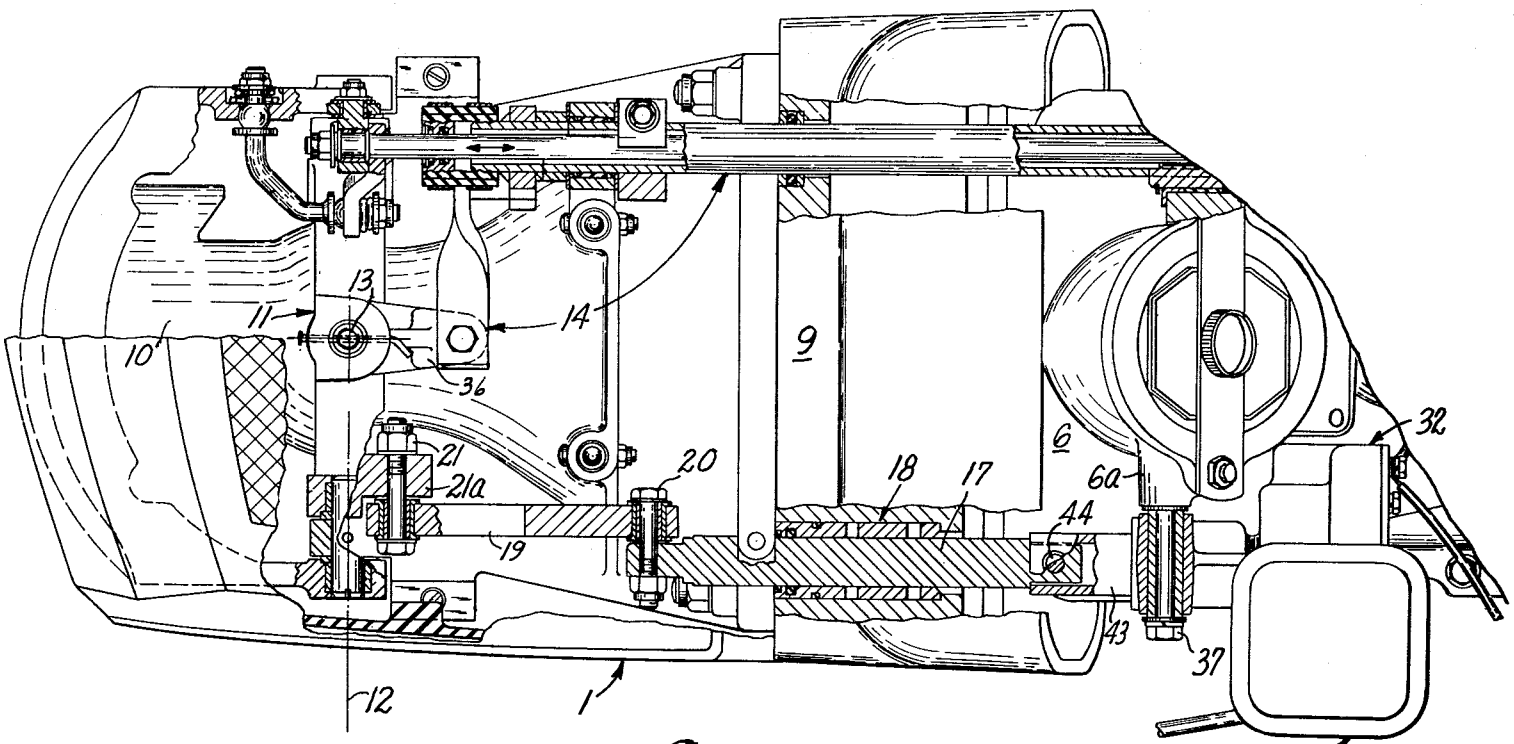
FIG. 2 is a top plan view illustrating a trim positioning mechanism.

Referring to the drawings, and particularly to FIG. 1, a marine jet propulsion unit or assembly 1 is shown mounted through the transom 2 of a partially shown watercraft 3 and sealed therein with a plate 4. The jet propulsion unit 1 includes an inlet unit 5 which is attached to the boat bottom 2*a* and supports a pump unit 6 drivingly connected to an engine 7 mounted inboard of the watercraft 3. In accordance with well-known practice, the pump unit 6 is adapted to draw water upwardly from an inlet unit 5 in the bottom portion 2*a* of the boat 3 and creates a high pressure drive jet 8 emitted from a rearwardly directed nozzle unit 9. The thrust forces create forward boat movement. A control or steering nozzle 10 is mounted to the aft end of the pump housing by a gimbal ring unit 11 which is shown pivotally supported on a horizontal axis 12 for trimming and, in turn, supports the steering nozzle 10 on a general vertical axis 13 for steering as shown in FIG. 2. A steering mechanism 14 is connected directly to the nozzle 10 on vertical axis 13 of gimbal ring 11 and to a steering wheel 15 on the boat 3 for positioning of the nozzle 10 within the gimbal ring unit 11 for steering. A trim positioning linkage 16 is connected to the gimbal ring unit 11 for pivoting of the gimbal ring 11 about the horizontal axis 12 for appropriate trim positioning of the jet 8.

Figure 4:
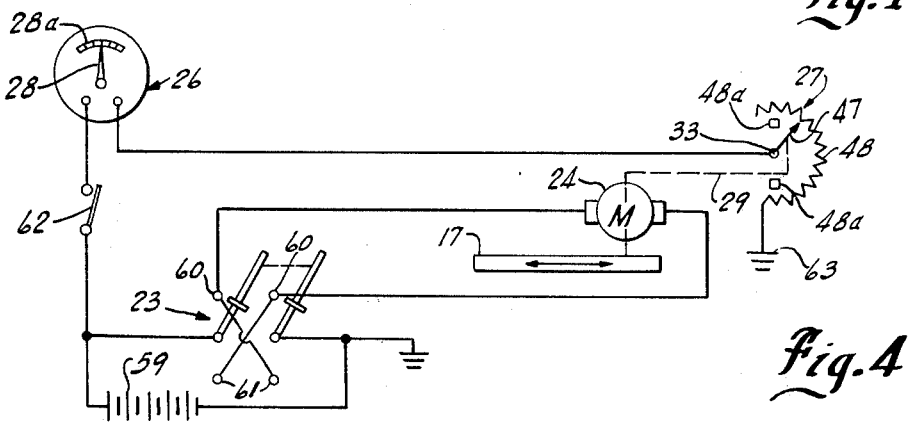
FIG. 4 is a schematic circuit of the trim positioning and indicating system.
Figure 3:
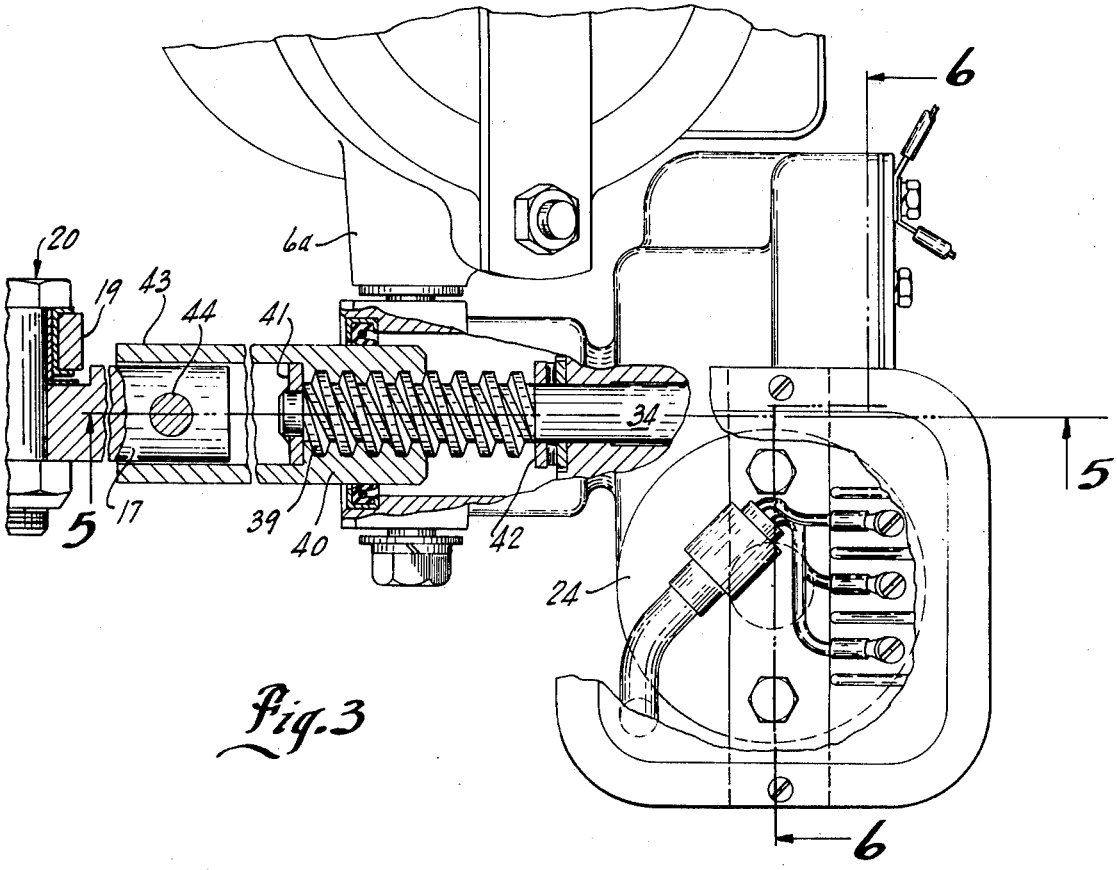
FIG. 3 is an enlarged fragmentary view of a portion of FIG. 2.

As most clearly shown in FIGS. 1 - 3, the trim positioning linkage 16 includes a trim rod 17 which is suitably journaled within a sliding bearing support 18 in the upper portion of the impeller housing 9. The outer end of the rod 17 is connected to a trim link 19 as by a pivot bolt unit 20. The link 19 is similarly secured by a pivot bolt unit 21 to an arm 22 on the gimbal ring 11. The axial reciprocation of the trim shaft or rod 17 results in a push-pull action on the gimbal ring 11 providing a corresponding pivoting of the gimbal ring 11 and interconnected nozzle 10 about the horizontal or trim axis 12 for trimming of jet 8. The trim shaft or rod 17 is connected in the illustrated embodiment of the invention to a motor driven trim actuator unit 22 mounted inboard of the water craft 3. The actuator unit 22 is controlled by a remote selection or control unit 23 located in the forward portion of the water craft 3 and generally adjacent the steering control wheel 15. The optimum trim position of the jet 8 varies with the orientation of the water craft 3 within the water. Thus, during starting and under normal operating conditions various trim angles are desirably employed. The trim angle selection unit 23 may conveniently be in the form of a simple three position switching unit such as shown in FIG. 4 and connected to energize a motor 24 which is coupled to position rod 17 of trim linkage 16 for moving the rod and nozzle 10 full-down and full-up trim positions.

Figure 5:
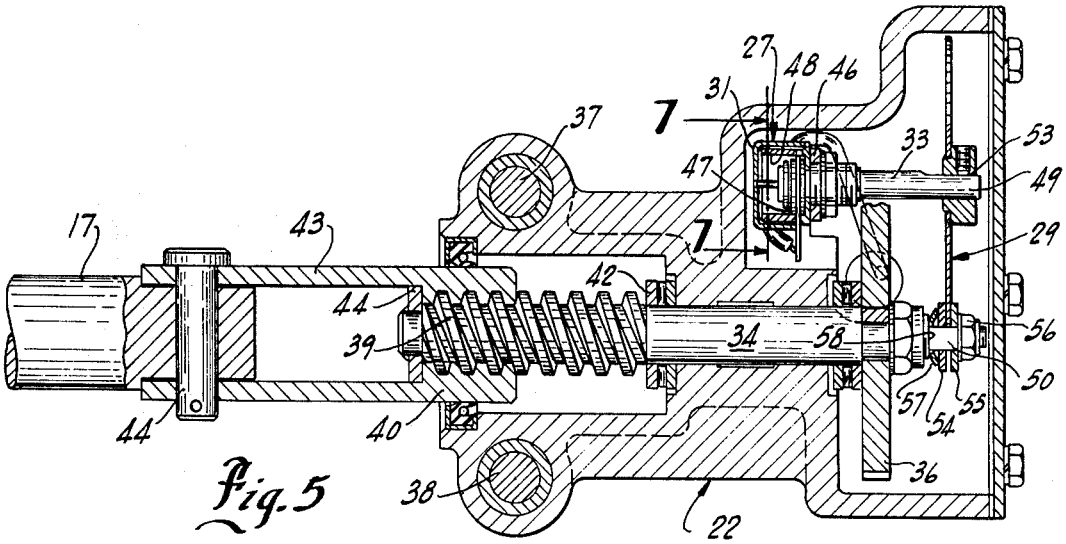
FIG. 5 is a sectional view taken generally on line 5—5 of FIG. 3.
Figure 6:
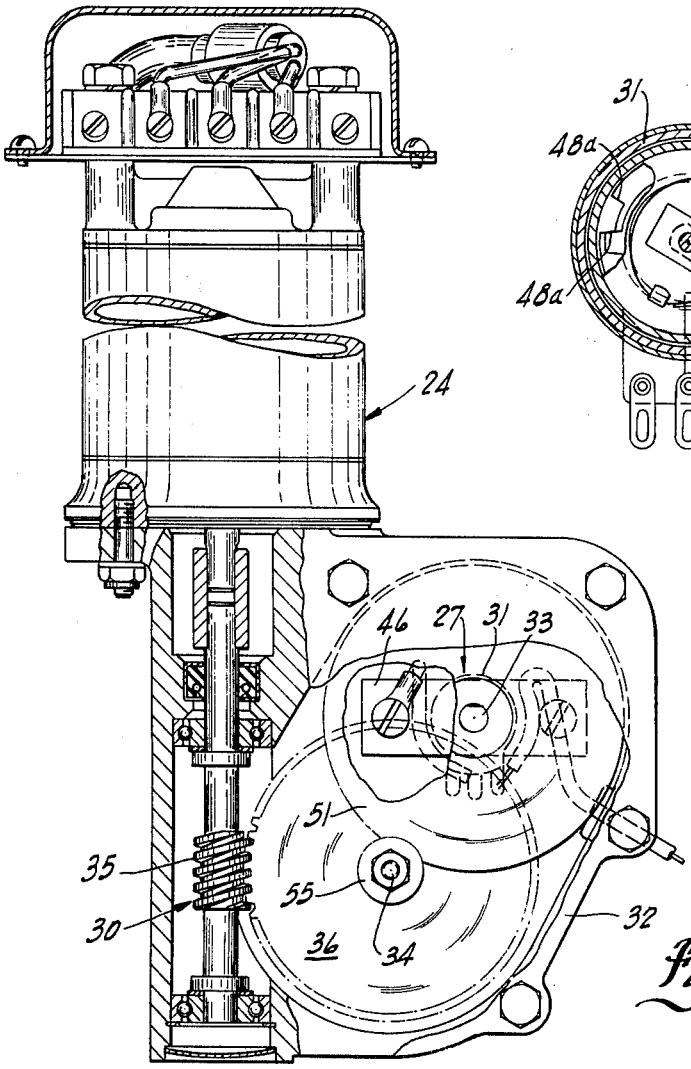
FIG. 6 is a sectional view taken generally on line 6—6 of FIG. 3.

In order that the operator is continuously informed of the particular trim position of the nozzle 10 and jet 8, a meter or other visible readout unit 26 is preferably provided immediately adjacent to the steering station. The meter unit 26 is connected to a position transducer or signal unit 27 which is coupled to motor 24 and actuates the unit 26 to indicate the trim position. The illustrated meter 26 includes a pointer 28 which moves across a scale 28a which is preferably graduated to read directly in accordance with the angular trim position of the jet 8. Generally, in the drawings the transducer unit 27 is mounted and coupled through a unique slip coupling means 29 to motor 24 in accordance with a preferred embodiment of this invention for simultaneous positioning of the transducer unit 27 and the trim linkage 16, as shown in FIGS. 5 and 6 and more fully described hereinafter. Generally, in the illustrated embodiment of the invention, the motor 24 is connected to linkage 16 by a reduction gear and linear motion unit or assembly 30. The transducer unit 27 is a potentiometer having ahousing 31 mounted within a gear casing 32 of unit 30, and includes an input shaft 33 connected to a spaced, parallel actuator shaft 34 by a unique slip coupling disc unit 29 to provide a signal related to the trim positioning of the nozle 10 and jet 8.

The propulsion unit 1 illustrated in FIG. 1 and the trim linkage 16 is similar to that more fully disclosed in the copending application of William L. Woodfill entitled "JET DRIVE APPARATUS WITH NON-STEERING JET REVERSE DEFLECTOR," which is assigned to the same assignee as the present application. The propulsion unit 1 may be of any other widely varying construction and is shown in a practical embodiment for purposes of fully illustrating the present invention. No further detailed description of the propulsion unit is, therefore, given other than as necessary to clearly and fully describe a novel structure of the present invention, and, in particular the coupling unit 29.

More particularly as shown most clearly in FIGS. 5 and 6, in the illustrated embodiment of the invention, the trim actuator unit 22 includes the small DC reversible electric motor 24 connected by the reducing gear unit 30 to the trim rod 17.

As shown in FIG. 6, motor 24 is connected to drive a worm 35 which is coupled to rotate a worm gear 36 secured to the end of the actuator shaft 34, and located within casing 32, as shown in FIGS. 5 and 6. The casing 32 is attached to the pump housing 6a by suitable mounting bolts 37 and 38 and supports the shaft 34 in alignment with the reciprocating rod 17 of linkage 16. The outer end of the shaft 34 includes a threaded or worm portion 39 with an Acme nut 40 mounted thereon and axially positioned in accordance with the rotation of the actuator shaft 34. The outer end of shaft 34 includes a stop washer 41 which limits the outward travel of the nut and defines one limit of travel. The opposite limit is defined by the base portion 42 of the bearing support within casing 32. The nut 40 includes a tubular extension or body 43 which telescopes over the end of the rod 17 of linkage 16. The outer body 43 of the Acme nut is pinned as at 44 or otherwise secured to the adjacent end of the trim rod 17 for corresponding positioning of linkage 16, the gimbal ring 11 and, therefore, the steering nozzle 10. The nut travels between the full-up and full-down trim positioned in accordance with rotation of the motor 24 and actuator. In an actual construction, the gear 36 and actuator shaft 34 were rotated 8 full revolutions in positioning the steering nozzle 10 between full-up and full-down trim positions.

The transducer unit 27 is corresponding positioned to actuate the meter unit 26, as follows.

Figure 7:
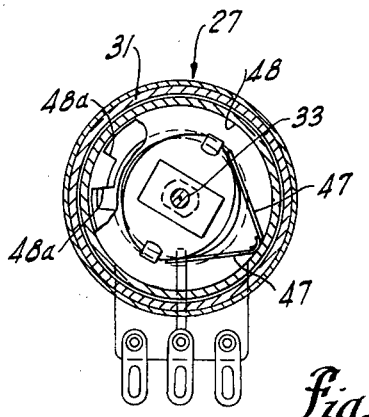
FIG. 7 is an enlarged view of a potentiometer unit with the housing broken away to show detail of construction.

The illustrated transducer unit 27 is shown as a conventional potentiometer unit including a cylindrical housing 31 which is fixedly mounted on a suitable bracket 46 within the actuator gear housing 32. The potentiometer unit 27 includes the shaft 33 which extends outwardly parallel to the actuator shaft 34. The potentiometer 27 includes a contact wiper 47 which is secured to the inner end of shaft 33 and rotates over a resistor 48 mounted in fixed relation within housing 31. The wiper 47 and shaft 33 rotate through about 270° in moving over the complete range of the resistor 48 and is physically held between those limits as by stops 48*a*, for example as shown in FIG. 7 and diagrammatically shown in FIG. 4. The position of shaft 33 is, therefore, a precise indication of the resistor position and output of the potentiometer. The outer free end 49 of shaft 33 (FIG. 5) is aligned with as outer free end 50 of the actuator shaft 34 within casing 32. The slipping disc coupling 29 interconnects shafts 49 and 50 as follows. A relatively large disc 51 is secured to the potentiometer shaft 49 as by a staked bushing 52 which is secured to the shaft by set screw and offset shaft connection 53. The radium of disc 51 generally corresponds to the distance between the potentiometer shaft 49 and the outer periphery of the actuator shaft 50. A pair of small clamping discs or washers 54 and 55 are affixed to the actuator shaft 50 and located one each to the opposite side of disc 51 to resiliently and frictionally clamp the disc 51 therebetween. In the illustrated embodiment of the invention, the actuator shaft 50 and the corresponding openings of the discs 54 and 55 include flat sides which with a small lock nut 56 secured to the outer end of the shaft 50 connect the discs for rotation with shaft 34. A Belleville spring 57 is shown located between the innermost disc 54 and a shoulder 58 defined by the reduction of the extension shaft portion 50 to frictionally and resiliently grasp the periphery of the large disc 51. Although the friction surfaces are relatively small, the potentiometer unit 27 creates a relative light load such that reliable and positive tracking by the potentiometer shaft 33 of the actuator shaft 34 is obtained. As previously described, shaft 33 is limited in travel by the internal construction of the potentiometer unit 27. Further, the disc coupling may or may not, and generally will not, connect the shafts 33 and 34 with the same trim positions during the initial installation or upon subsequent maintenance and the like. The potentiomenter 27 must be properly adjusted, which, as more fully developed hereinafter, directly results from running the nozzle 10 between the two trim limit positions.

Referring particularly to FIG. 4, a simplified schematic diagram of the trim operating and sensing circuit is illustrated. The trim control switch 23 is shown as a three position switch for reversibly connecting of the D.C. trim motor 24 to the conventional battery power supply 59 for raising and lowering of the nozzle 10 and jet 8. Thus, the switch 23 includes an open position disconnecting of motor 24 from supply 59, up-position closing contacts 60 and connecting motor 24 to the supply 59 with one polarity and a down-position for closing contacts 61 and connecting motor 24 to the supply with an opposite polarity connection. In accordance with well-known operation, this produces a reversible motor output for corresponding reverse rotation of the gear train and, therefore, the nut 43 and interconnected shaft 17 and link 19 of trim linkage 16.

The trim gauge or meter 26 is shown having one side connected to the battery supply 59 through an on-off control switch 62. The opposite side of the meter 26 is connected to the potentiometer and, in particular, to the potentiometer wiper 47 hich, in turn, is carried by the potentiometer shaft 33. In accordance with well-known construction the potentiometer wiper 47 engages the resistor 48, one end of which is connected to common ground 63 with the power supply. The amount of resistance connected in a series with the meter 26 therefore varies directly with the position of the wiper 47 which is coupled to the trim position drive. The meter 26 is thus correspondingly driven with a current directly proportional to and thereby related to the position of the trim motor 24 and related gear coupling. The meter 26 is thus actuated to correspondingly position the pointer and produce a visual readout of the trim position.

The trim motor 24 sets the trim linkage 16 and thus gimbal ring unit 11 and nozzle 10 between the full-down or full-up positions and thereby defines the two trim limit positions of the nozzle. The slipping disc coupling 29 of the illustrated embodiment of the present invention provides for direct proper tracking and angular positioning of the wiper 47 with the trim positioning of the steering nozzle 10. Similarly, the actuator shaft and therefore the wiper 47 is movable between two extreme positions providing maximum introduction of resistance and minimum introduction of resistance into the circuit. This relationship follows, however, only if the setting of the potentiometer starts from a trim indicating position corresponding to the actual trim position of the trim motor 24 and nozzle 10. The illustrated embodiment of this invention provides a simple, reliable and relatively inexpensive apparatus for insuring the proper positioning and phasing of the potentiometer unit 27 by sequential energization of the trim motor 24 to establish the two maximum limit trim positions. The disc coupling 29 creates a corresponding movement of the potentiometer shaft 33 and wiper 47. If the wiper 47 is not properly phased, the wiper 47 reaches its limit position or stop 48*a* before the trim actuator 34 and nozzle reaches the corresponding trim limit position. The trim unit will continue to be driven to its limit position. The potentiometer wiper 47 remains in the end or limit position corresponding to the full trim position with slippage between disc 51 and the clamping discs 54 and 55 providing for this independent movement of the trim motor and trim positioning mechanism. Thereafter, upon opposite trim positioning of the nozzle 10 from such limit, the wiper 47 is immediately picked up and provides corresponding simultaneous positioning with proper phasing of the potentiometer unit 27 and accurate readout by motor 26. Thus, to establish proper phased positioning of the trim motor unit and the wiper, it is merely necessary to run the trim unit to full-up and full-down position to insure that the wiper has been properly picked up and phased with the trim unit.

Although the illustrated embodiment of the invention is shown driving a meter, the present invention can, of course, be incorporated into any other indicating system and/or a suitable servo system for corresponding automatic positioning of the drive unit.

In summary, this invention provides a simple, reliable and inexpensive construction particularly adapted for incorporation into the motor driven trim positioning systems or remote positioning systems for jet propulsion units and the like.

Various modes of carrying out the invention are contemplated as being within the scope of the following claims, particularly pointing out and distinctly claiming the subject matter which is regarded as the invention.

I claim:

1. A sensing apparatus for sensing the angular positioning of a pivotally mounted marine drive unit including a power positioning means, said power positioning means having a position related means having a precise degree of movement between first and second limits in positioning of the marine propulsion means between two opposite limit positions, comprising an electrical transducer means having a mechanical input means and movable between two opposite limit positions, means for mounting said transducer means with the mechanical input means located in parallel spaced relation to said position related means, a clutch means having a first clutch element secured to said mechanical input means and a second clutch element secured to said position related means, said first and second clutch elements extending from said mechanical input means and from said position related means and including constantly overlapping portions resiliently and frictionally engaging each other to position the transducing means in accordance with the power positioning means and permitting relative slipping motion of the elements with the mechanical input means in one of said opposite limit positions as the position related means moves to said first or second limit positions.

2. The sensing apparatus of claim 1 wherein one of said clutch elements is a plate-like member and the other of said clutch elements is a pair of plate-like members with the outer peripherial portion overlapping and resiliently clamped to the peripheral portion of the first-named plate-like member.

3. The sensing apparatus of claim 1 wherein said power transducing means is a potentiometer unit having a housing and a rotating shaft defining said mechanical input means, said first clutch element is a rotating member secured to said rotating shaft, said second clutch element is a pair of rotating members rotationally secured to said position related means and resiliently gripping the peripheral edge of the rotating member to establish corresponding positioning of the transducing means.

4. In the sensing apparatus of claim 1 wherein said power positioning means includes a gear train and a connecting rigid linkage connected to the drive unit.

5. A sensing apparatus for sensing the angular positioning of a pivotally mounted marine drive unit having a remotely controlled power positioning means, said power positioning means having a reversible rotating member having a precise degree of rotation in positioning of the marine propulsion means between two opposite positions, comprising an electrical transducing means having a rotating mechanical input member movable between first and second limits, means for mounting said transducer means to said power positioning means and having the rotating input member located in parallel spaced relation to said reversible rotating member, a clutch means having a first rotating plate element secured to the input member and a second rotating plate rotationally secured to the reversible rotating member, said plates having an overlapping portion and at least one of said elements being forced axially into resilient frictional engagement with the other of said elements to establish corresponding positioning of the transducing means and permitting relative slipping motion of the elements with the rotating input member in said first or second limit.

6. The sensing apparatus of claim 5 wherein a reversible rotating member is an actuator shaft establishing less than one complete revolution for each movement of the marine drive unit, said shaft including an exposed portion, said transducing means including a potentiometer fixedly mounted and said input means being input shaft mounted in aligned laterally spaced relation to said actuator shaft, said first element is a disc member secured to said potentiometer shaft, said second clutch element is a second and third pair of disc members rotationally secured to said actuator shaft one to each side of said first disc member, and spring means resiliently urging the second and third disc members into engagement to thereby resiliently clamp the first disc member between said second and third disc members.

7. The sensing apparatus of claim 6 wherein said first disc member has a radius generally corresponding to the distance between the axis of the input shaft and the periphery of the actuator shaft, and said second and third disc members have a substantially smaller radius to frictionally grip the edge portion of the first disc member.

8. The sensing apparatus of claim 5 wherein said power positioning means includes an electric motor, a gear drive system coupling said electric motor to said drive unit, said gear unit including a rotating actuator shaft defining said reversible rotating member and establishing more than one complete revolution for each extreme limit movement of the drive unit, said shaft including an exposed portion, said transducer means being a potentiometer fixedly mounted within said gear unit and including a reversible input shaft defining said input member and mounted in aligned laterally spaced relation to said actuator shaft, and said clutch elements being secured to said shafts.

9. The sensing apparatus of claim 8 wherein said first element is a disc plate having a radius generally corresponding to the distance between the axis of the potentiometer shaft and the periphery of the actuator shaft, said second element is a second and third pair of disc plates rotationally secured to said actuator shaft one to each side of said first disc plate, spring means on said actuator shaft bias said second and third discs to resiliently clamp the first disc plate between said second and third disc plates whereby said potentiometer shaft reversibly tracks said actuator shaft.

10. In a jet trim apparatus including a trim positioning power motor means having a rotating actuator member, for positioning a jet drive steering nozzle means, a transducer means fixedly mounted adjacent the motor means and including a rotating input member mounted in aligned laterally spaced relation to said actuator member and movable between first and second limits, a slipping clutch means having a first clutch plate element secured to said input member and a second clutch plate element rotationally secured to the actuator member, said clutch plate elements projecting outwardly into overlapping side peripheral engagement of the side faces of said plate elements, and means resiliently urging the clutch elements to frictionally clamp the first clutch element to engage the second clutch element and permitting relative slipping motion of the element with the rotating input member in said first or second limit.

11. In the jet trim apparatus of claim 10 having a trim linkage connected to said nozzle means, said motor means including a trim positioning electric motor, a gear system coupling said electric motor to said steering nozzle to create a direct rigid connection, said gear system and said transducer means include parallel rotating shafts defining said actuator shaft and said input shaft, said clutch elements being disc plates secured to said shafts, a first of said plates having a radius generally corresponding to the distance between the axis of the input shaft and the periphery of the actuator shaft, and the other of said plates being sufficiently large to grasp only the periphery of the first of said plates.

12. The apparatus of claim 11 wherein a spring is mounted on one of said shafts and resiliently engages one of said disc plates to resiliently clamp the disc plate against the disc plate on the opposite shaft.

13. The jet trim apparatus of claim 10 including a gear drive system coupling said motor means to said jet steering nozzle means, said gear system means including a rotating actuator shaft defining said actuator member and establishing more than one complete revolution for each movement of the steering nozzle means between full-up trim and full-down trim, said shaft including an exposed portion, said transducer means having an input shaft defining said input member, said clutch elements being secured to said shafts and projecting outwardly into overlapping peripheral relationship.

14. In the jet apparatus of claim 13 wherein said gear system includes a worm connected to the motor and a worm gear connected to said actuator shaft, a rotary to linear motion coupling connecting said actuator shaft to said trim linkage, said worm gear establishing less than one complete revolution for each movement of the steering nozzle between full-up trim and full-down trim.

15. The trim apparatus of claim 14 wherein said transducer means includes a potentiometer having a housing fixedly mounted within said gear housing and including said input shaft mounted in aligned laterally spaced relation to said actuator shaft within said housing, said clutch elements including a first disc secured to said input shaft and having the radius generally corresponding to the distance between the axis of the input shaft and the periphery of the actuator shaft, a second and third pair of discs rotationally secured to said actuator shaft one to each side of said first disc, and spring means on said actuator shaft biasing said second and third discs to engage said first disc.

16. The apparatus of claim 15 wherein said spring means includes stop means secured to the outer end of said actuator shaft, a spring secured to the outer to the opposite side of said second and third discs and resiliently urging the adjacent disc toward the first disc to thereby resiliently clamp the first disc between said second and third discs.

17. In the jet trim apparatus of claim 10 wherein a trim linkage is connected to said nozzle means, said motor means is an electric motor, a gear system connects said electric motor to said trim linkage, said gear system includes a rotating actuator shaft defining said actuator member and establishing more than one complete revolution for each movement of the steering nozzle between full-up trim and full-down trim, said shaft including an exposed portion, said transducer means includes a potentiometer fixedly mounted and including an input shaft defining said input means and mounted in aligned laterally spaced relation to said actuator shaft, a first clutch element being a first disc secured to said potentiometer shaft and having the radius generally corresponding to the distance between the axis of the input shaft and the periphery of the actuator shaft, said second clutch element being second and third discs secured to said actuator shaft one to each side of said first disc, stop means secured to one side of said second and third discs, a spring secured to the opposite side of said second and third discs and resiliently urging the second and third discs toward each other to thereby resiliently clamp the periphery of the first disc between said second and third discs.

* * * * *

UNITED STATES PATENT AND TRADEMARK OFFICE

CERTIFICATE OF CORRECTION

PATENT NO. : 4,051,801

DATED : October 4, 1977

INVENTOR(S) : WILLIAM L. WOODFILL and EDWARD F. GINNOW

It is certified that error appears in the above-identified patent and that said Letters Patent are hereby corrected as shown below:

| | | | | |
|---|---|---|---|---|
| Column | 2, | Line | 20, | before "two" cancel "the" and insert --- The ---; |
| Column | 4, | Line | 18, | after "housing" cancel "ahous-" and insert --- a hous- ---; |
| Column | 5, | Line | 19, | before "outer" cancel "as" and insert --- an ---; |
| Column | 5, | Line | 25, | cancel "radium" and insert --- radius ---; |
| Column | 6, | Line | 5, | cancel "hich" and insert --- which ---; |
| Column CLAIM 10 | 8, | Line | 64, | cancel "element" and insert --- elements ---; |
| Column CLAIM 16 | 10, | Line | 9, | cancel "to the outer". |

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*